US010070701B1

(12) United States Patent
Liu

(10) Patent No.: US 10,070,701 B1
(45) Date of Patent: Sep. 11, 2018

(54) BUCKLE DEVICE

(71) Applicant: BO CAI ENTERPRISE CO., LTD., Tainan (TW)

(72) Inventor: Kuan Hung Liu, Tainan (TW)

(73) Assignee: Bo Cai Enterprise Co., Ltd., Tainan (TW)

( * ) Notice: Subject to any disclaimer, the term of this patent is extended or adjusted under 35 U.S.C. 154(b) by 30 days.

(21) Appl. No.: 15/804,172

(22) Filed: Nov. 6, 2017

(51) Int. Cl.
*A44B 11/12* (2006.01)
*A42B 3/08* (2006.01)

(52) U.S. Cl.
CPC ..... *A44B 11/125* (2013.01); *A42B 3/08* (2013.01)

(58) Field of Classification Search
CPC ..... A44B 11/125; A42B 3/08
See application file for complete search history.

(56) References Cited

U.S. PATENT DOCUMENTS 5,172,454 A * 12/1992 Martignago ..... A43C 11/1406 24/68 SK
5,606,779 A * 3/1997 Lu ..... A43C 11/146 24/68 SK
6,684,667 B2 * 2/2004 Young ..... A41F 1/008 70/18
7,877,845 B2 * 2/2011 Signori ..... F16B 2/08 24/68 SK
9,155,359 B1 * 10/2015 Bailey ..... A43C 11/146
9,332,798 B2 * 5/2016 Gafforio ..... A42B 3/08
2002/0189056 A1 * 12/2002 Gallina ..... A44B 11/12 24/68 R
2003/0019081 A1 * 1/2003 Livingston ..... A43C 11/1406 24/68 R
2010/0162539 A1 * 7/2010 Rancon ..... A43C 11/1453 24/70 ST
2012/0297591 A1 * 11/2012 Bozzetto ..... A43C 11/146 24/68 SK
2013/0047388 A1 * 2/2013 Kavarsky ..... A43C 11/1413 24/68 SK

* cited by examiner

*Primary Examiner* — David M Upchurch
(74) *Attorney, Agent, or Firm* — Rosenberg, Klein & Lee

(57) ABSTRACT

A buckle device includes a seat body, a belt body having saw-toothed sections, and a control member. An actuating portion and a linkage portion of the control member are pivotally connected to the seat body through a rotating shaft. The actuating portion and the linkage portion are provided with a first return elastic member and a second return elastic member, respectively. The tops and the bottoms of the actuating portion and the linkage portion are provided with raised blocks and raised teeth to engage with the saw-toothed sections, respectively. The user can pull the actuating portion with one hand for the raised teeth of the actuating portion and the linkage portion to disengage from the saw-toothed sections.

3 Claims, 5 Drawing Sheets

BUCKLE DEVICE

FIELD OF THE INVENTION

The present invention relates to a buckle device, and more particularly to a buckle device that can be operated with one hand for buckling and unbuckling a belt body.

BACKGROUND OF THE INVENTION

A buckle device is one of critical structures of a helmet. Especially, when the wearer's helmet is hit because of an accident, the buckle device may loosen and fall due to an instantaneous impact force. Sometimes, the wearer's neck is cut by the locking component of the buckle device to endanger life. Therefore, if the buckle device cannot be buckled tightly or cannot avoid loosening when the helmet is hit, wearing a helmet has lost its significance. In addition to the need to buckle the buckle device tightly and to prevent loosening, whether the belt and the buckle structure can be operated with ease also affects the wearer's willingness to use the helmet. Especially in the cold winter, many people will wear gloves when riding a motorcycle to keep warm. When the rider arrives at the destination, he/she must first remove the gloves to hold the belt with one hand and to unbuckle the buckle device with the other hand. It is inconvenient for use.

In order to improve the above-mentioned deficiencies, please refer to WO 2015/056545, which discloses a buckle. A main shaft between two side plates of a housing is pivotally connected with a press member. A secondary shaft at the front end of the housing is pivotally connected with an operation lever. A main spring and a secondary spring are fitted on the main shaft and the secondary shaft, respectively. Wherein, a housing base, the press member and the operation lever can be folded into a Z-shape. The press member can be driven to turn by pulling the operation lever to disengage the press member from the housing base so that the buckle can be operated with one hand.

In addition, referring to WO 2010/117147, there is disclosed a buckle device for length adjustment. Two ends of a base unit are provided with a locking unit and a lever unit, respectively. The respective other ends of the locking unit and the lever unit, not connected with the base unit, are interconnected crosswise. When a belt unit having a plurality of saw teeth is inserted in the base unit, the lever unit can be rotated by pulling the lever unit with one hand to disengage the locking unit from the saw teeth of the belt unit.

SUMMARY OF THE INVENTION

In view of the shortcomings of the conventional buckle device that is inconvenient for one-handed operation, there is still a need for improvement.

The primary object of the present invention is to provide a buckle device. An actuating portion and a linkage portion of the buckle device are pivoted to the same rotating shaft, which facilitates the user's one-handed operation.

Another object of the present invention is to provide a buckle device. The actuating portion and the linkage portion of the buckle device are provided with raised teeth to engage with the belt body, which enhances the safety of use.

In order to achieve the aforesaid objects, the buckle device of the present invention comprises a seat body, a belt body, and a control member. The seat body is formed with a passage. The passage has two side walls each formed with a perforation. A first retaining bar and a second retaining bar are provided at respective inner sides of the two side walls, respectively. The belt body is inserted through the passage. The belt body includes a plurality of saw-toothed sections thereon. One end of the control member is pivotally connected to the seat body. The control member includes an actuating portion, a linkage portion, a rotating shaft, a first return elastic member, and a second return elastic member. The actuating portion has a notch, a first groove, and a pair of first through holes at two sides of the notch. A first raised block and at least one first raised tooth corresponding to the saw-toothed sections of the belt body are provided on a top and a bottom of the actuating portion, respectively. The linkage portion is disposed in the notch of the actuating portion and formed with a second through hole and a second groove. A second raised block and at least one second raised tooth corresponding to the saw-toothed sections of the belt body are provided on a top and a bottom of the linkage portion, respectively. The rotating shaft is inserted through the perforations of the two side walls of the seat body, the first through holes of the actuating portion, and the second through hole of the linkage portion. Two ends of the first return elastic member are connected to the first retaining bar and the first groove of the actuating portion, respectively. Two ends of the second return elastic member are connected to the second retaining bar and the second groove of the linkage portion, respectively.

Based on the aforesaid, the user can pull the actuating portion with one hand for the first raised block of the actuating portion to touch the second raised block of the linkage portion to disengage the first raised tooth and the second raised tooth of the actuating portion and the linkage portion from the saw-toothed sections of the belt body. When the user releases his/her hand, the actuating portion and the linkage portion are returned by the torsion of the first and second return elastic members, thereby achieving the effect of opening the buckle with one hand.

DETAILED DESCRIPTION OF THE PREFERRED EMBODIMENTS

Embodiments of the present invention will now be described, by way of example only, with reference to the accompanying drawings.

Figure 1:
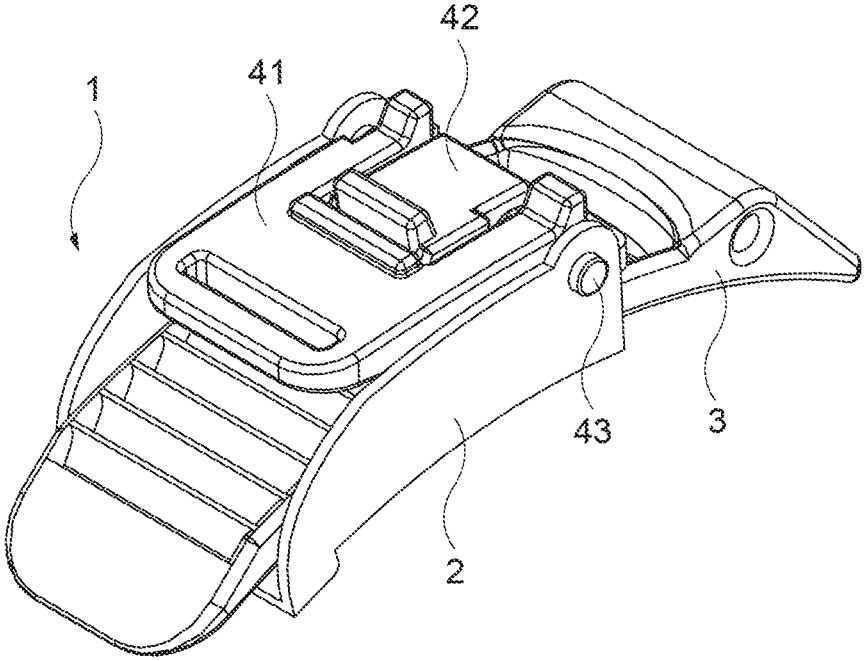
FIG. 1 is a perspective view of the present invention.
Figure 2:
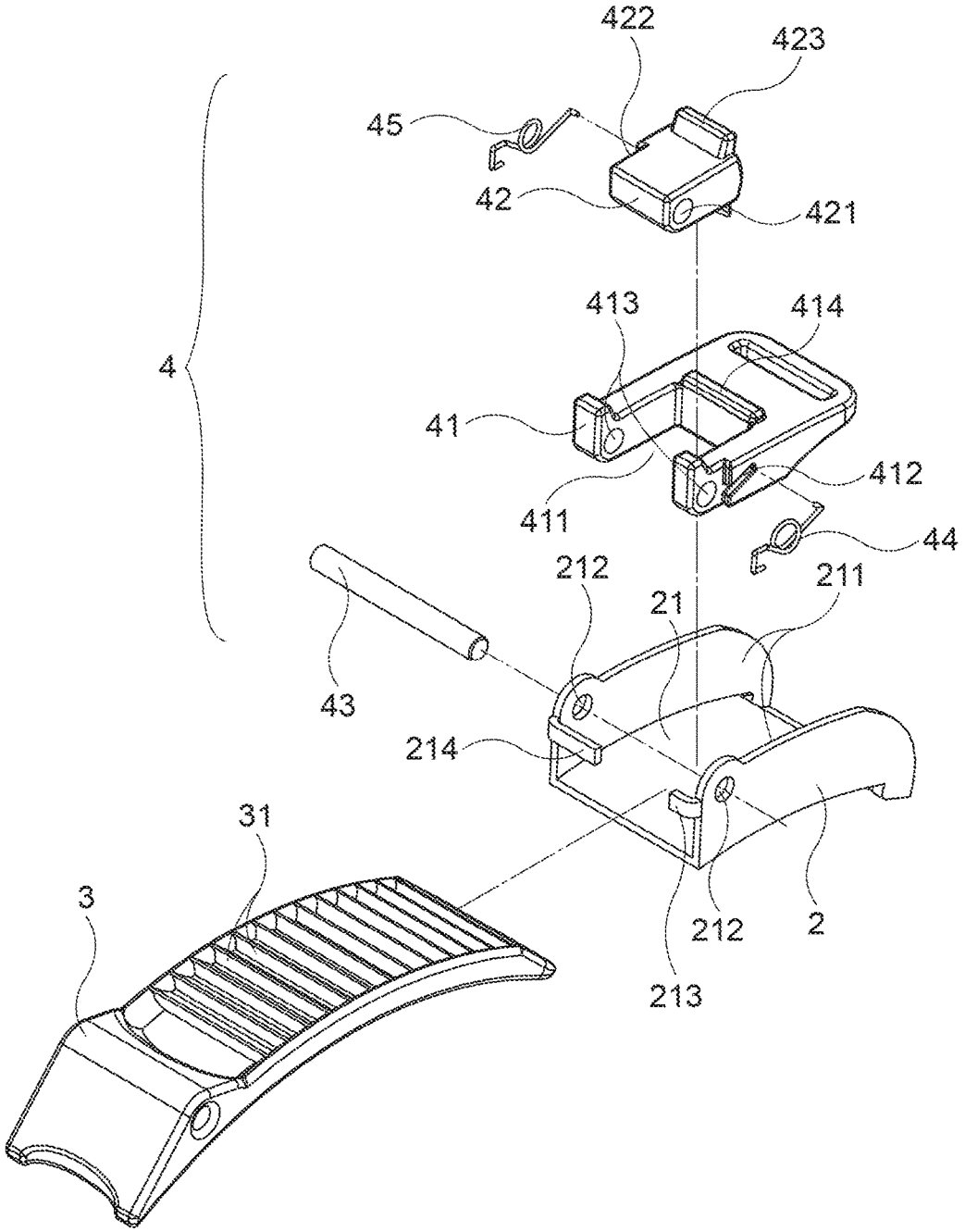
FIG. 2 is an exploded view of the present invention.
Figure 3:
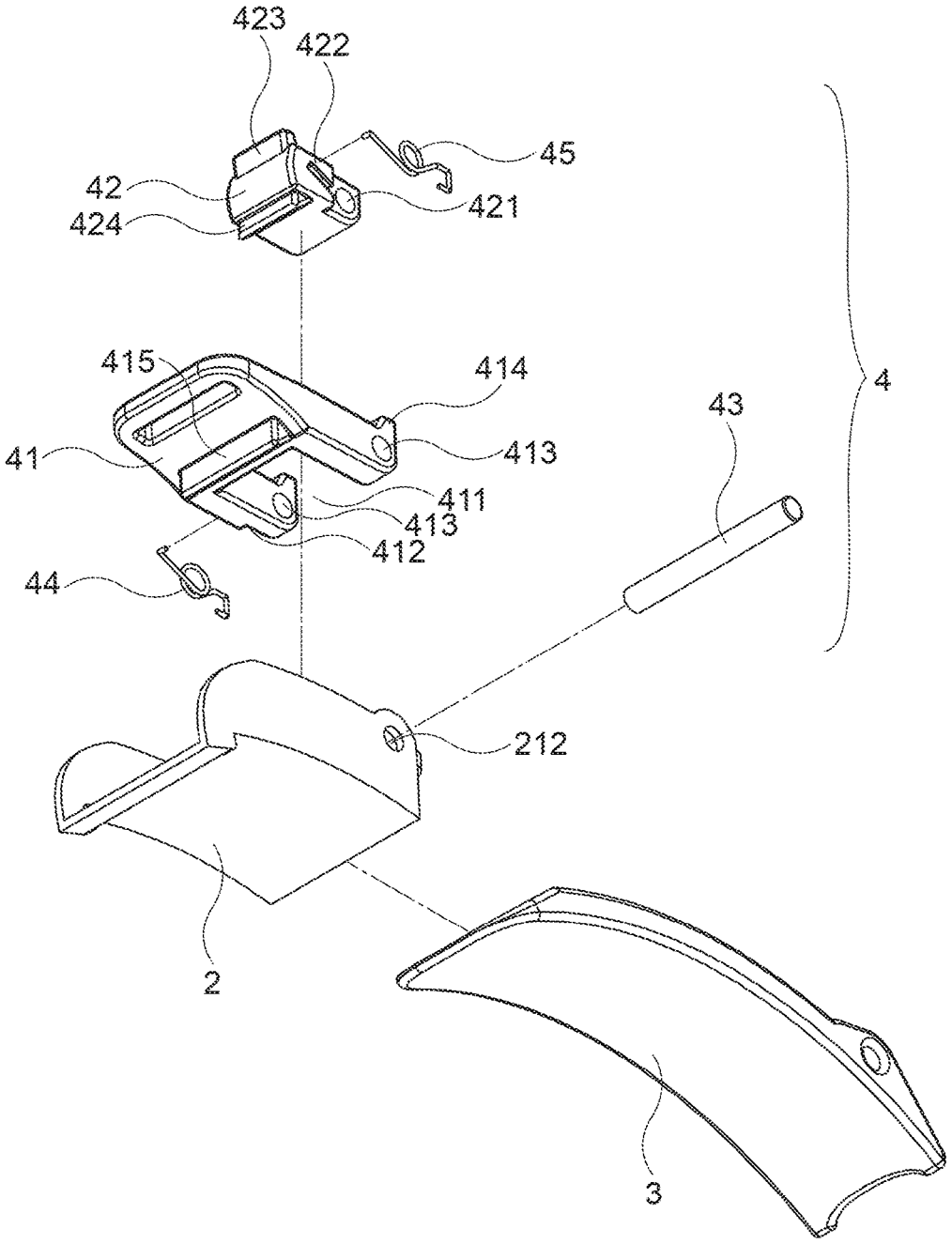
FIG. 3 is an exploded view of the present invention seen from another angle.

Referring to FIG. 1 to FIG. 3, a buckle device 1 comprises a seat body 2, a belt body 3, and a control member 4. The seat body 2 is formed with a passage 21. The passage 21 has two side walls 211 each formed with a perforation 212. A first retaining bar 213 and a second retaining bar 214 are provided at the inner sides of the two side walls 211, respectively. The belt body 3 is inserted through the passage 21 of the seat body 2. The belt body 3 includes a plurality of saw-toothed sections 31 thereon. One end of the control member 4 is pivotally connected to the seat body 2. The control member 4 includes an actuating portion 41, a linkage portion 42, a rotating shaft 43, a first return elastic member 44, and a second return elastic member 45. Wherein, the actuating portion 41 has a notch 411, a first groove 412, and a pair of first through holes 413 at two sides of the notch 411. A first raised block 414 and at least one first raised tooth 415 corresponding to the saw-toothed sections 31 of the belt body 3 are provided on the top and the bottom of the actuating portion 41, respectively. The linkage portion 42 is disposed in the notch 411 of the actuating portion 41 and is formed with a second through hole 421 and a second groove 422. A second raised block 423 and at least one second raised tooth 424 corresponding to the saw-toothed sections 31 of the belt body 3 are provided on the top and the bottom of the linkage portion 42, respectively. The rotating shaft 43 is inserted through the perforations 212 the two side walls 211 of the seat body 2, the first through holes 413 of the actuating portion 41, and the second through hole 421 of the linkage portion 42. Two ends of the first return elastic member 44 are connected to the first retaining bar 213 of the seat body 2 and the first groove 412 of the actuating portion 41, respectively. Two ends of the second return elastic member 45 are connected to the second retaining bar 214 of the seat body 2 and the second groove 422 of the linkage portion 42, respectively. In an embodiment of the present invention, the first return elastic member 44 and the second return elastic member 45 are torsion springs. The height of the second raised block 423 of the linkage portion 42 is greater than the height of the first raised block 414 of the actuating portion 41. One end of the actuating portion 41, not having the notch 411, is adapted for coupling a pull member (not shown).

Figure 4:
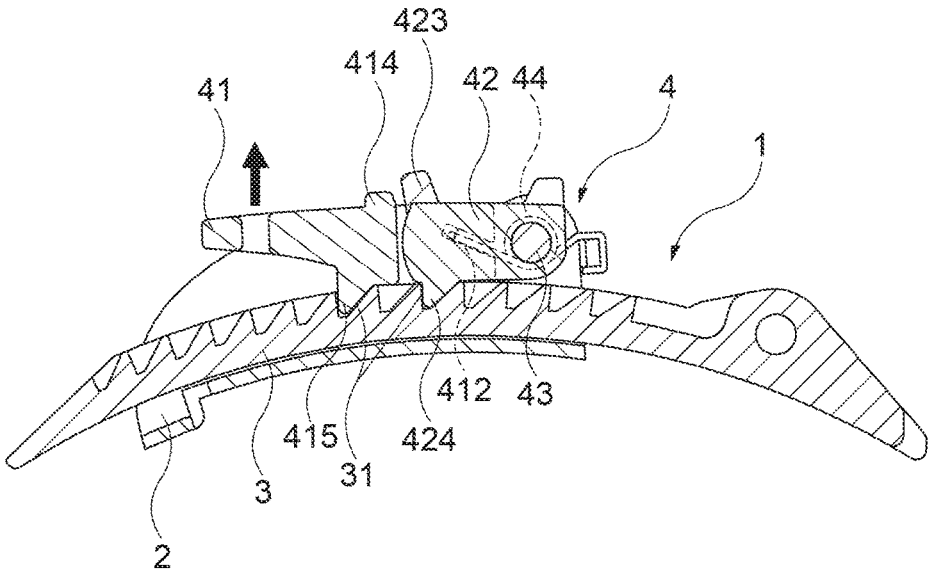
FIGS. 4-6 are schematic views of the present invention in an unlocked state.
Figure 5:
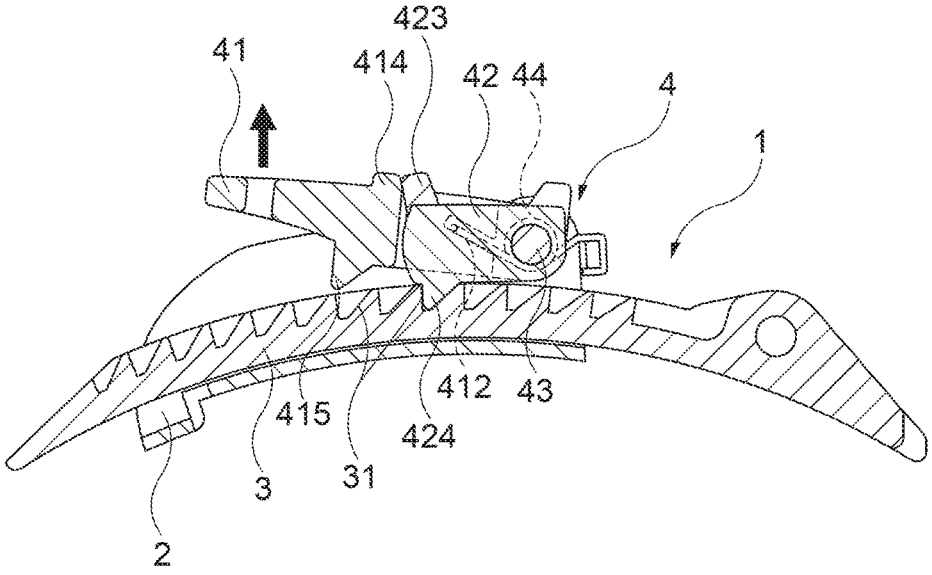
Figure 6:
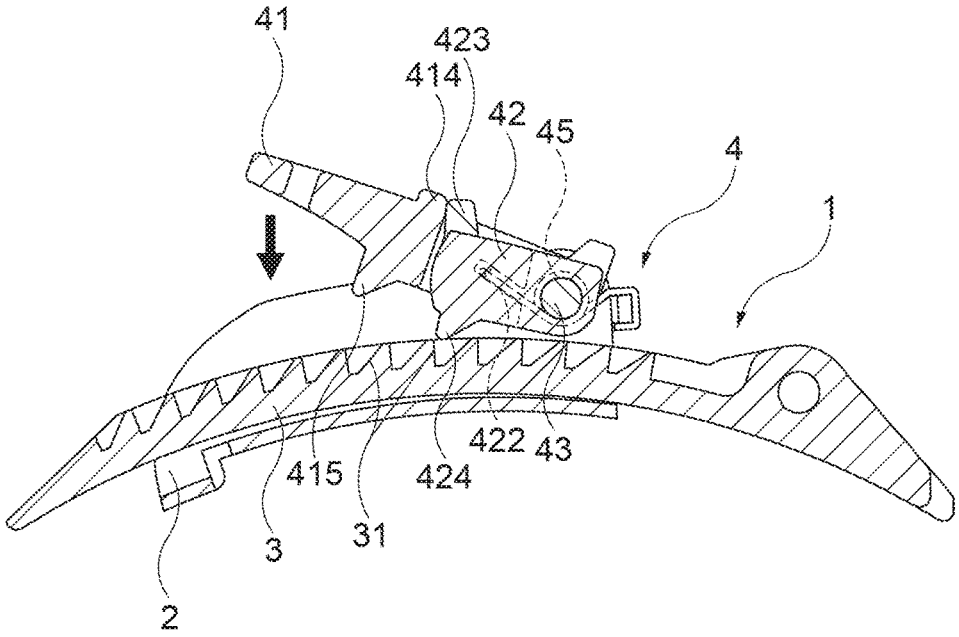

As shown in FIG. 4, when the control member 4 and the belt body 3 are in a locked state, the actuating portion 41 can be pulled upward (as shown in FIG. 5) to disengage the first raised tooth 415 from the saw-toothed sections 31 of the belt body 3, meanwhile, the first raised block 414 of the actuating portion 41 touches the second raised block 423 of the linkage portion 42 to lift the linkage portion 42 synchronously and to disengage the second raised tooth 424 from the saw-toothed sections 31 of the belt body 3 (as shown in FIG. 6). At this time, the first return elastic member 44 disposed on the actuating portion 41 and the second return elastic member 45 disposed on the linkage portion 42 are twisted by the external force, so that the belt body 3 is smoothly disengaged from the seat body 2.

Figure 7:
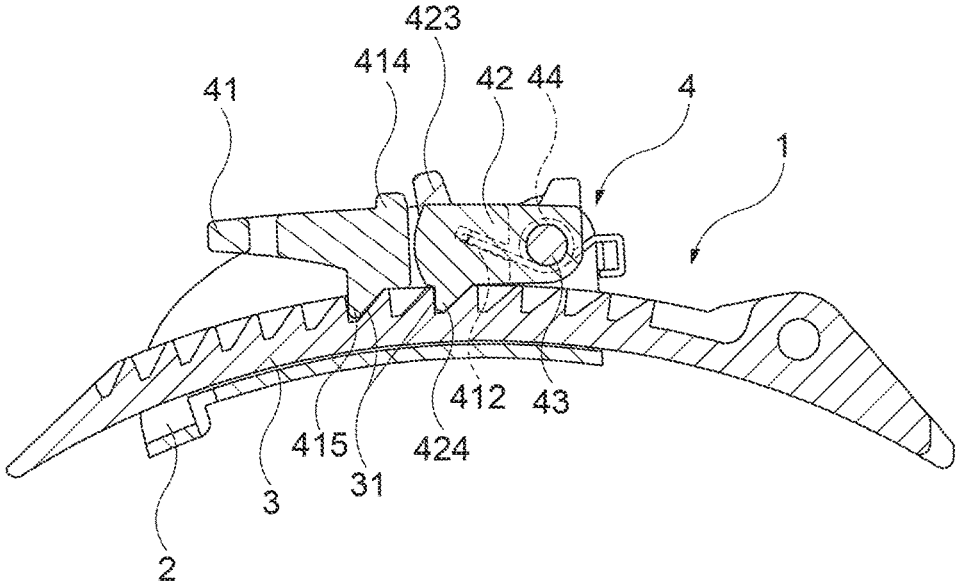
FIG. 7 is a schematic view of the present invention in a locked state.

Referring to FIG. 6, when the buckle device is to be buckled, because the first raised tooth 415 and the second raised tooth 424 of the actuating portion 41 and the linkage portion 42 are disengaged from the saw-toothed sections 31 of the belt body 3, the belt body 3 is inserted into the passage 21 of the seat body 2, and then the actuating portion 41 is loosened for the actuating portion 41 and the linkage portion 42 to be pulled to the initial position by the elastic restoring forces of the first return elastic member 44 and the second return elastic member 45, as shown in FIG. 7. At this time, the first raised tooth 415 and the second raised tooth 424 of the actuating portion 41 and the linkage portion 42 are engaged with the saw-toothed sections 31 of the belt body 3 so that the buckle device 1 is in a locked state.

It is to be noted that the actuating portion 41 and the linkage portion 42 of the control member 4 of the present invention are pivoted by a single rotating shaft 43 so as to facilitate the user's one-handed operation and to reduce the number of components, thereby reducing the chance to damage the components of the buckle device 1 due to frequent pulling. Furthermore, the bottoms of the actuating portion 41 and the linkage portion 42 are provided with the first raised tooth 415 and the second raised tooth 424 respectively for engaging the saw-toothed portion 31 of the belt body 3. The two-stage locking mechanism enables the buckle device 1 to be used more safely and prevents the buckle device 1 from being loosened because one of the first raised tooth 415 and the second raised tooth 424 of the actuating portion 41 and the linkage portion 42 is broken, thereby achieving an easy operation and enhancing the locking strength.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A buckle device, comprising:

a seat body, the seat body being formed with a passage, the passage having two side walls each formed with a perforation, a first retaining bar and a second retaining bar being provided at respective inner sides of the two side walls respectively;

a belt body, the belt body being inserted through the passage, the belt body including a plurality of saw-toothed sections thereon; and a control member, one end of the control member being pivotally connected to the seat body, the control member including:

an actuating portion, the actuating portion having a notch, a first groove and a pair of first through holes at two sides of the notch, a first raised block and at least one first raised tooth corresponding to the saw-toothed sections of the belt body being provided on a top and a bottom of the actuating portion respectively;

a linkage portion, the linkage portion being disposed in the notch of the actuating portion and formed with a second through hole and a second groove, a second raised block and at least one second raised tooth corresponding to the saw-toothed sections of the belt body being provided on a top and a bottom of the linkage portion respectively;

a rotating shaft, inserted through the perforations of the two side walls of the seat body, the first through holes of the actuating portion and the second through hole of the linkage portion;

a first return elastic member, two ends of the first return elastic member being connected to the first retaining bar and the first groove of the actuating portion respectively; and a second return elastic member, two ends of the second return elastic member being connected to the second retaining bar and the second groove of the linkage portion respectively.

2. The buckle device as claimed in claim 1, wherein the first return elastic member and the second return elastic member are torsion springs.

3. The buckle device as claimed in claim 1, wherein the second raised block of the linkage portion has a height greater than that of the first raised block of the actuating portion.

* * * * *